US006042439A

United States Patent [19]

Parten

[11] Patent Number: 6,042,439

[45] Date of Patent: Mar. 28, 2000

[54] WATER RECREATION BOARD WITH PASS-THROUGH TOW ROPE

[76] Inventor: Keith Parten, 572 #1 Campo, Fort Worth, Tex. 76107

[21] Appl. No.: 08/942,470

[22] Filed: Oct. 2, 1997

[51] Int. Cl.[7] ..... B63B 1/00

[52] U.S. Cl. ..... 441/65; 441/69; 441/74; 114/253

[58] Field of Search ..... 441/65, 74, 68, 441/69, 79; 114/357, 253

[56] References Cited

U.S. PATENT DOCUMENTS

| | | | |
|---|---|---|---|
| D. 390,618 | 2/1998 | Wilson | D21/228 |
| 2,735,115 | 2/1956 | Dees | 441/65 |
| 2,910,708 | 11/1959 | Albright . | |
| 2,928,109 | 3/1960 | Wilber . | |
| 3,340,554 | 9/1967 | Allender | 441/65 |
| 4,678,445 | 7/1987 | Monreal | 441/65 |
| 5,083,955 | 1/1992 | Echols | 441/65 |
| 5,618,215 | 4/1997 | Glydon | 441/65 |
| 5,797,779 | 8/1998 | Stewart | 441/65 |

OTHER PUBLICATIONS

"L.L. Bean", Summer 1998, p. 117.

*Primary Examiner*—Stephen Avila
*Attorney, Agent, or Firm*—Melvin A. Hunn

[57] ABSTRACT

A rigid water recreation board for towing behind a water vessel. There is an eyelet extending through the board. A rope is attached to the vessel and freely passes through the eyelet. A handle is attached to the rope and is dimensioned such that it may not pass through the eyelet. A rider may lie upon, kneel upon, or stand upon the board as it is being towed by the vessel. The rider has the option of holding onto the handle or letting the handle be pulled against the upper surface of the board while the board is in tow by the vessel.

4 Claims, 6 Drawing Sheets

WATER RECREATION BOARD WITH PASS-THROUGH TOW ROPE

BACKGROUND OF THE INVENTION

1. Field of the Invention

This invention relates to water recreation devices, especially devices for riding that are towed behind a boat or vessel.

2. Background Information

Water recreation devices such as kick boards, water skis, knee boards, and surf boards have been around for a long time. Some are designed to be towed behind a boat or vessel and some are designed to be used by themselves in waves or currents. Kick boards and water skis have provided enjoyment for many years. Kick boards are generally used by swimmers for recreation or training. The swimmer can either hold the buoyant kick board out in front of himself or partially lie on the kick board to provide buoyancy while he kicks or trains. Water skis are an exciting way for a rider to stand up in the water and be towed by a boat or vessel at high speeds. Knee boards have made a more recent appearance on the water recreation scene. A rider kneels on the buoyant knee board and pulls a strap over his lap. The knee board rider can then be pulled by a boat or jet ski as he holds onto a tow rope. Surfers enjoy riding surf boards in many different positions, but generally, surf boards are not towed behind any sort of boat or vessel. Even though these recreational devices have been around for many years, their popularity has not diminished, in fact, many new models of each type are successfully introduced each year.

However, none of these devices combine the excitement and versatility of being towed by a boat or vessel and being able to ride the device in many different positions—or to spontaneously change riding positions—while retaining an option of either holding onto a tow rope, holding onto the device, or riding "hands-free." For example, none of these devices is designed to be pulled by a boat or vessel and to allow the rider to lie, sit, kneel, or stand on the device; however, the present invention does just that. It is a water recreation board that allows a rider to assume almost any position on the board—or to spontaneously change positions—and be towed by a boat or vessel, while maintaining an option of either holding onto a tow rope, holding onto the board, or riding hands-free and letting the tow rope pull the board.

SUMMARY OF THE INVENTION

It is the general object of the invention to provide a water recreation device for towing behind a boat or vessel that can be ridden in a lying, sitting, kneeling, or standing position.

This object is achieved by providing a water recreation board with a pass-through tow rope. The water recreation board is a rigid board for towing behind a boat or vessel. The water recreation board has a tapered forward end, a chamfered aft end, a generally flat, rough upper surface, and a smooth lower surface. The lower surface is joined to the upper surface, and an upward-turning lip is integrated into the lower surface at the forward end of the board. The water recreation board has an eyelet passing through it from the lower surface to the upper surface. A tow rope is attached at one end to a boat or vessel, passes through the eyelet from the lower surface of the board to the upper surface of the board, and attaches to a handle at the opposite end. The tow rope is free to pass through the eyelet unrestricted until the handle comes into contact with the upper surface of the board.

A rider may lie, kneel, sit, or stand on the board as it is being towed by the boat or vessel. The rider has the option of holding onto the handle, holding onto the board, or riding hands-free and letting the handle be pulled against the upper surface while the board is in tow by the boat or vessel. The rider may change positions while riding the board.

DESCRIPTION OF THE PREFERRED EMBODIMENT

Figure 1:
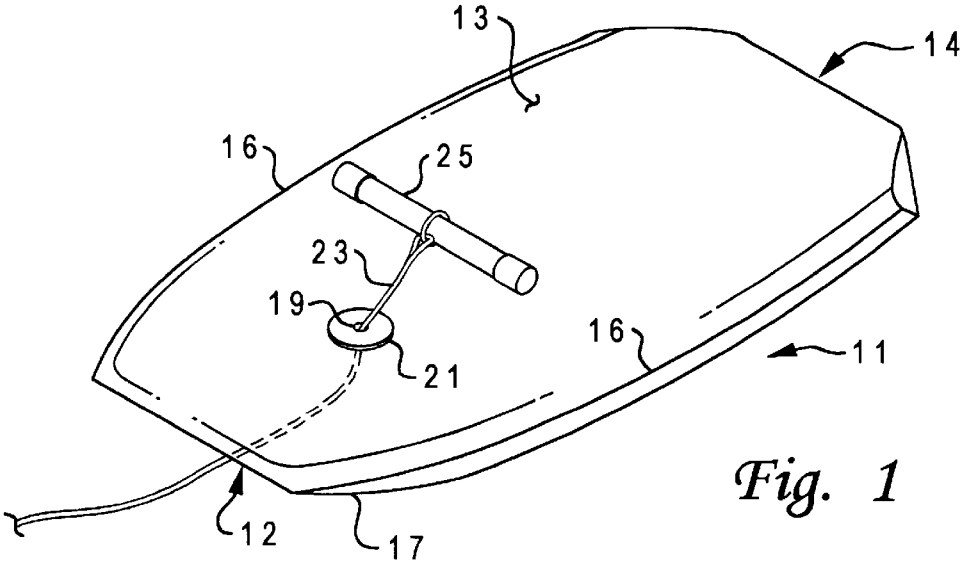
FIG. 1 is a perspective view of the water recreation board with pass-through tow rope of the present invention.
Figure 2:
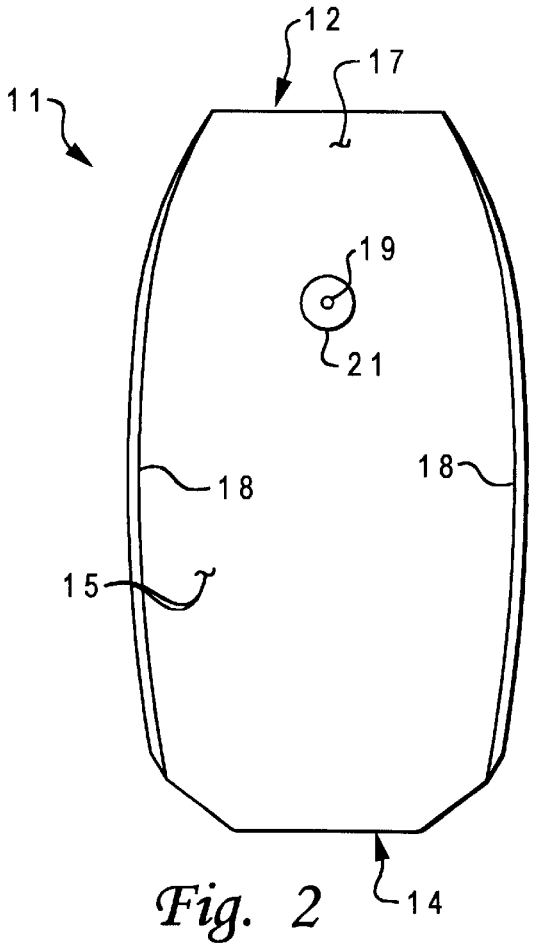
FIG. 2 is a bottom view of the water recreation board of FIG. 1.
Figure 3:
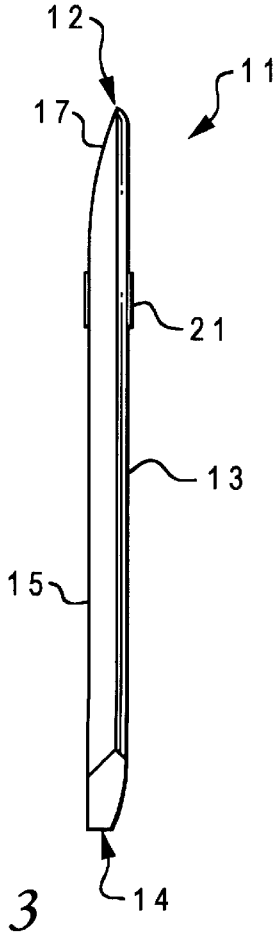
FIG. 3 is a left side view of the water recreation board of FIG. 1.

With reference now to the drawings, and in particular with reference to FIGS. 1, 2, and 3, the preferred embodiment of the water recreation board 11 of the present invention is illustrated. Board 11 is a lightweight, wide board preferably made of a rigid foam material, such as polyethylene. Board 11 has a forward end 12 and an aft end 14. The corners of forward end 12 are preferably rounded, and the corners of aft end 14 are preferably chamfered. Board 11 has a generally flat upper surface 13, preferably with a rough finish, and a generally flat lower surface 15, preferably with a smooth finish. Upper surface 13 may be concave. Upper surface 13 has an upper peripheral edge 16, preferably rounded over. Lower surface 15 has a lower peripheral edge 18, preferably chamfered. Upper surface 13 and lower surface 15 are joined together at the intersection of upper peripheral edge 16 and lower peripheral edge 18. Lower surface 15 preferably has an upturned lip 17 at forward end 12 of board 11 to reduce drag, particularly in the initial stage of being towed by a boat or vessel (not shown).

At least one aperture 19 extends through board 11 from upper surface 13 toward lower surface 15. Each aperture 19 is lined with an eyelet 21, preferably made of rigid plastic or nylon. A conventional tow rope 23, preferably a nylon ski rope, passes through eyelet 21 and is free to move therethrough without restriction. Rope 23 is adapted for attachment at one end to the vessel, passes through eyelet 21 in a direction from lower surface 15 toward upper surface 13, and is adapted for attachment to a conventional handle 25 at the opposing end. Handle 25 is dimensioned such that it is larger than eyelet 21; therefore, attachment of handle 25 to rope 23 prevents rope 23 from passing completely through eyelet 21 while board 11 is in tow.

In an alternate embodiment, lower surface 15 is formed and made smooth by adhering a thin sheet of material (not shown), preferably polyethylene or SURLYN™, to lower surface 15. Referring now to FIG. 4 through FIG. 11 in the drawings, eight different modes of operation of water recreation board 11 are illustrated. A rider 27 has an option of lying, sitting, kneeling, or standing on board 11. Regardless of the position rider 27 chooses, he or she also has an option of holding onto handle 25, holding onto board 11, or riding hands-free, that is, neither holding onto handle 25 nor board 11. If rider 27 chooses to ride either hands-free or holding onto board 11, handle 25 is pulled by the vessel toward upper surface 13 until handle 25 comes into contact with upper surface 13.

Figure 4:
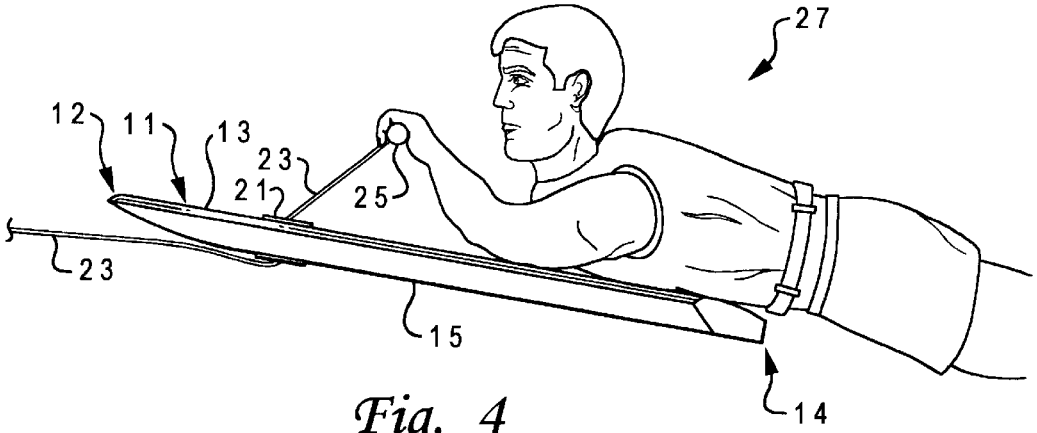
FIG. 4 is a perspective view of the first lying mode of operation of the present invention.
Figure 5:
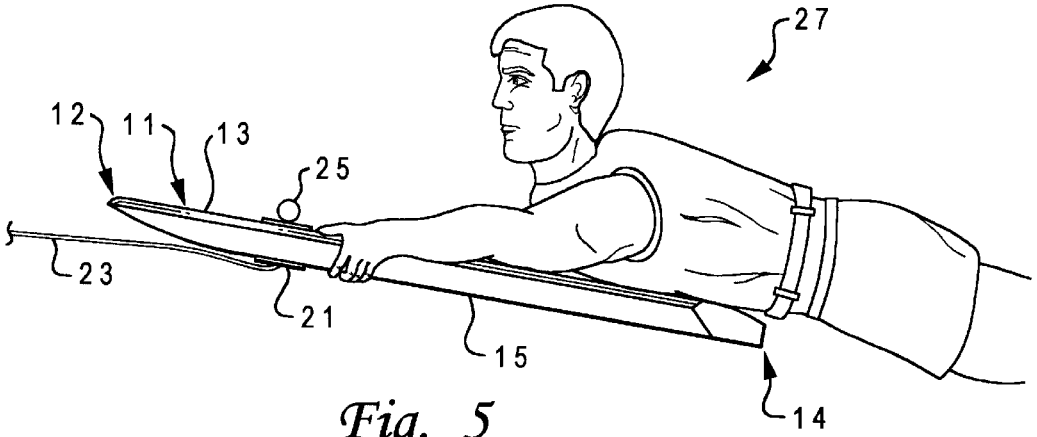
FIG. 5 is a perspective view of the second lying mode of operation.
Figure 6:
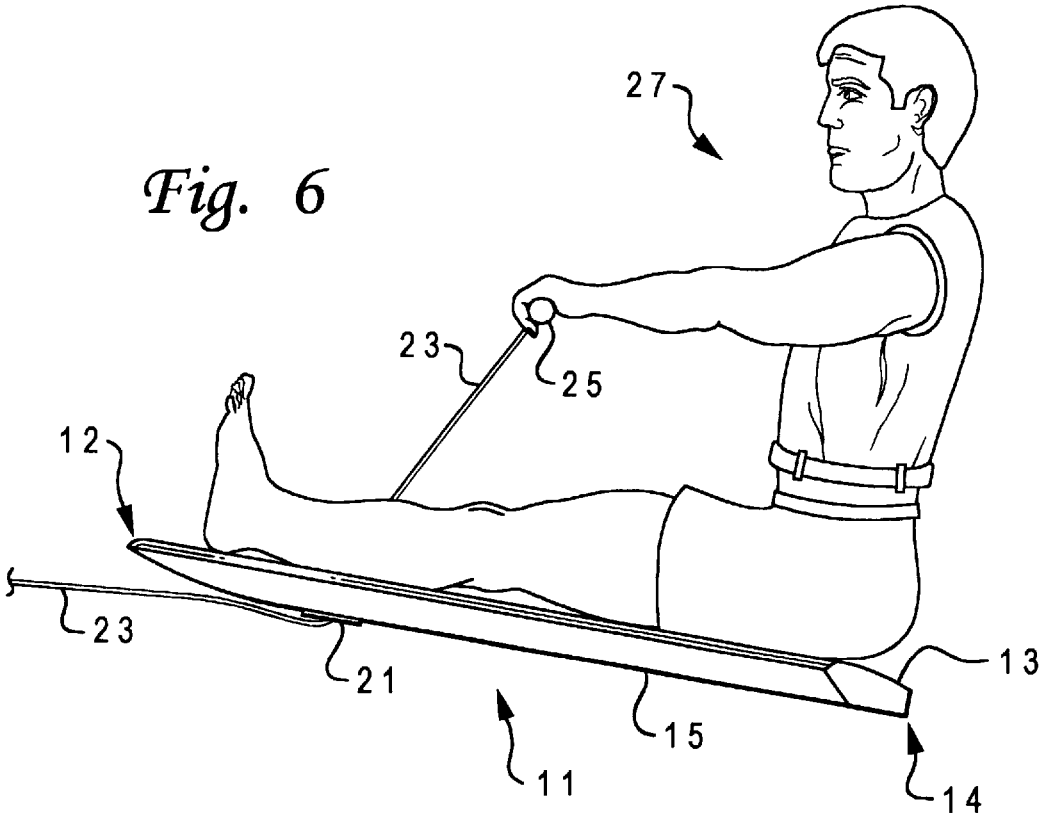
FIG. 6 is a perspective view of the first sitting mode of operation.
Figure 7:
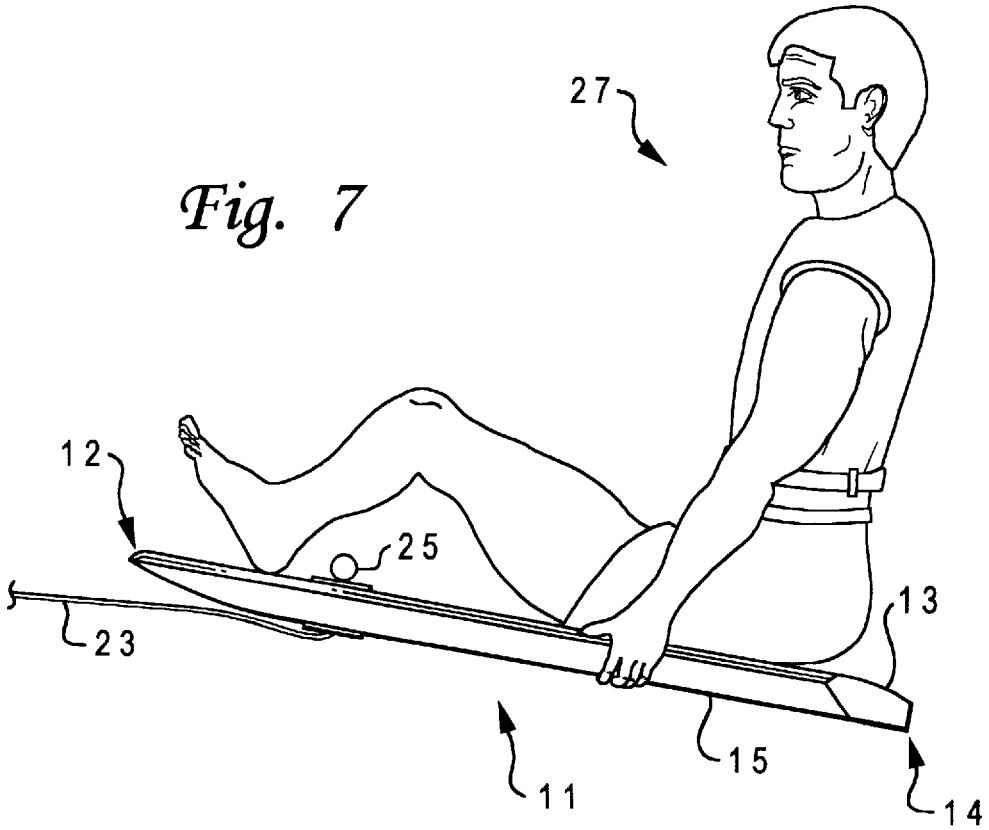
FIG. 7 is a perspective view of the second sitting mode of operation.
Figure 8:
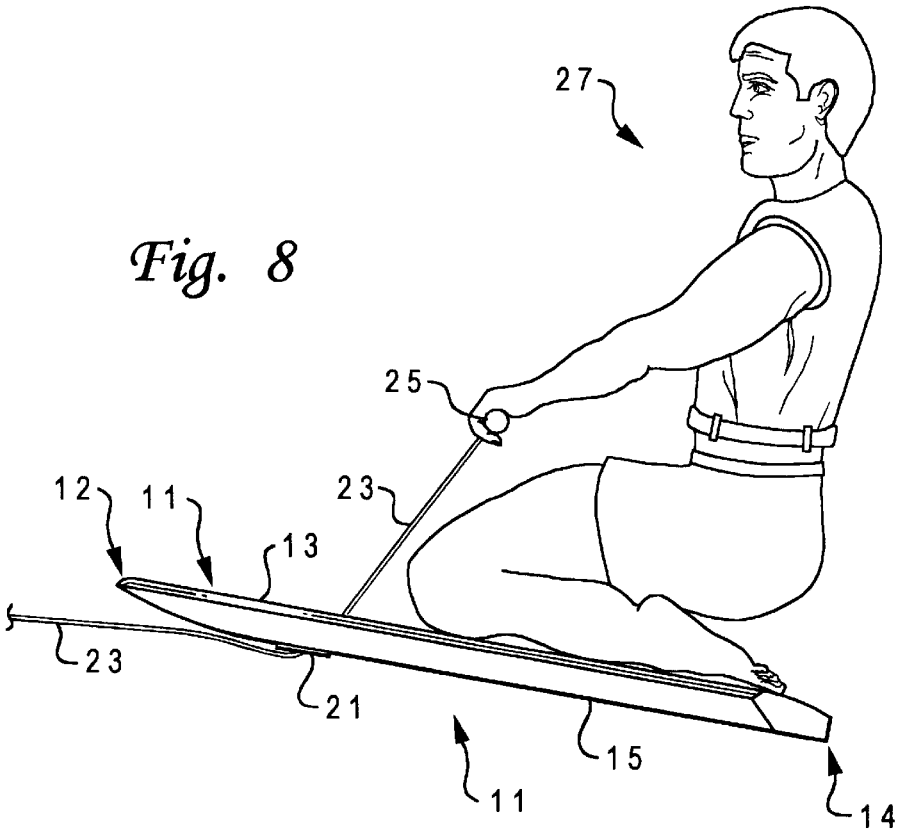
FIG. 8 is a perspective view of the first kneeling mode of operation.
Figure 9:
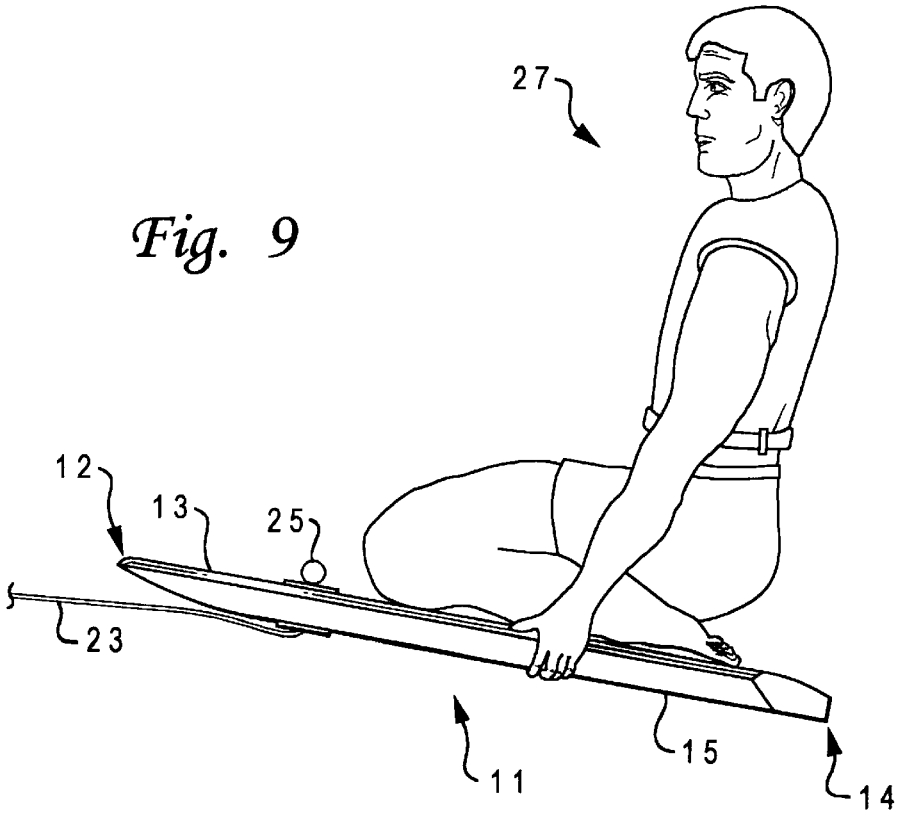
FIG. 9 is a perspective view of the second kneeling mode of operation.
Figure 10:
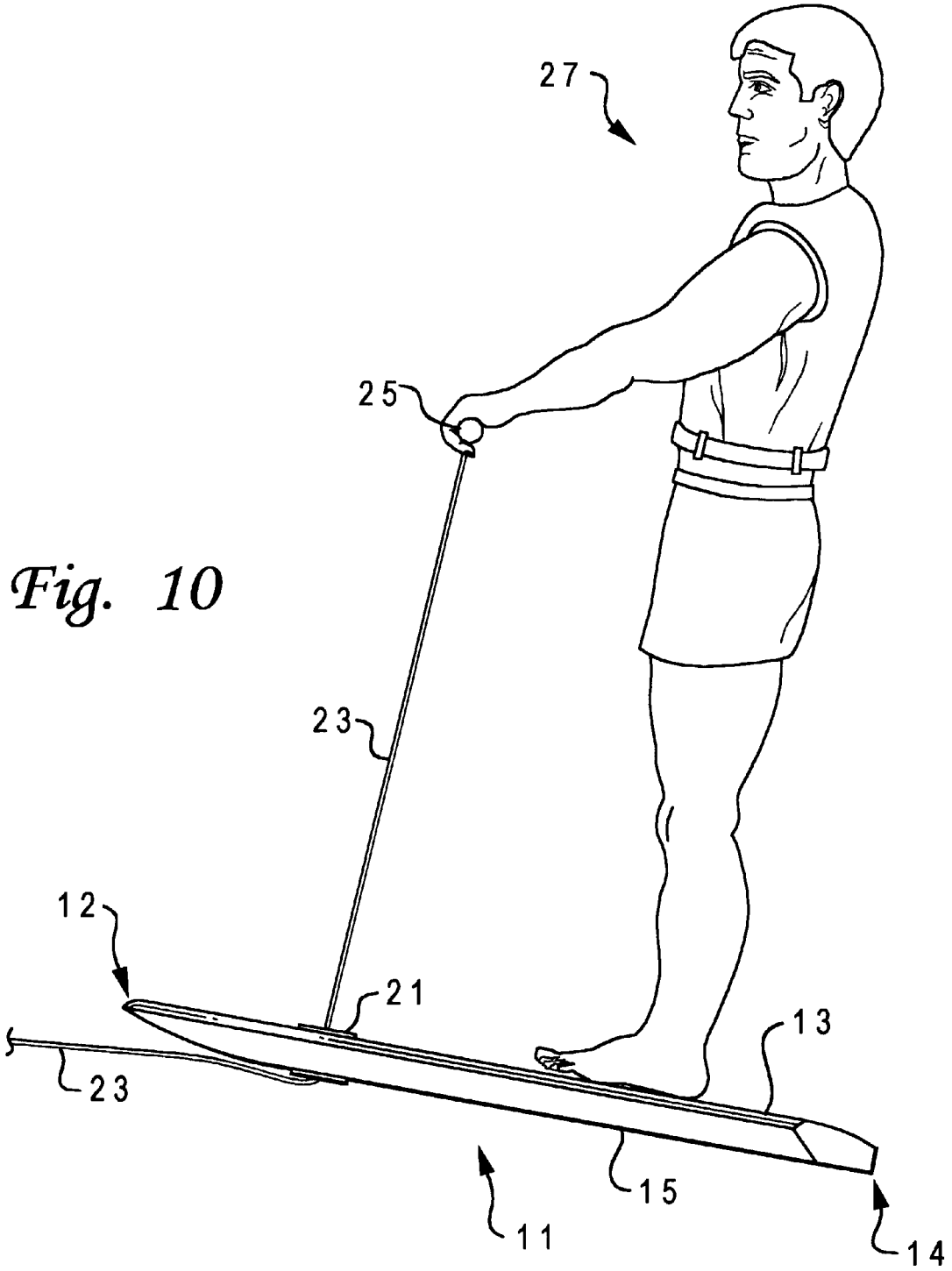
FIG. 10 is a perspective view of the first standing mode of operation.
Figure 11:
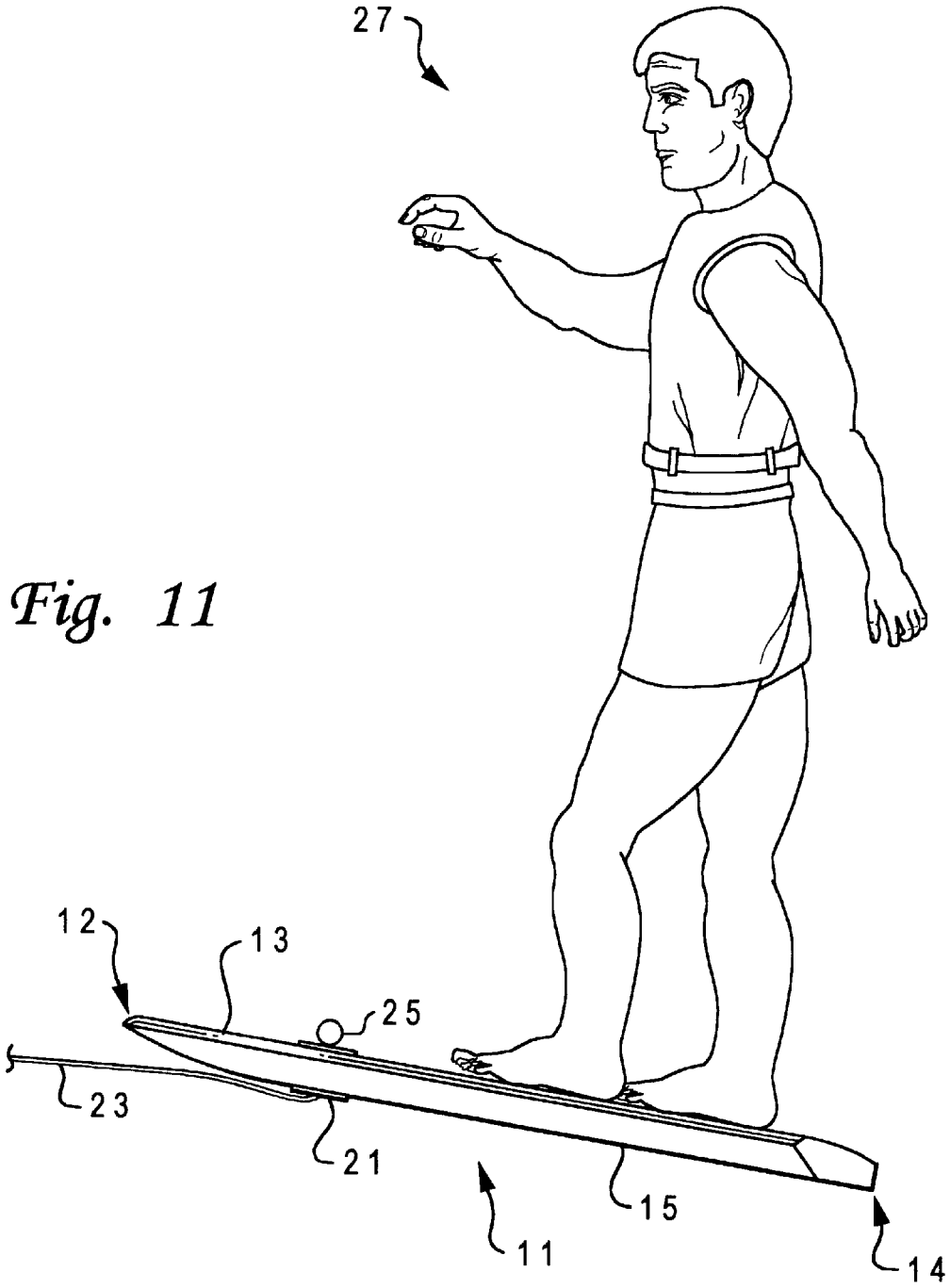
FIG. 11 is a perspective view of the second standing mode of operation.

In FIG. 4, rider 27 operates board 11 in a first lying mode in which he lies on board 11 and holds onto handle 25. In FIG. 5, rider 27 operates board 11 in a second lying mode in which he lies on board 11 and holds onto board 11. In FIG. 6, rider 27 operates board 11 in a first sitting mode in which he sits on board 11 and holds onto handle 25. In FIG. 7, rider 27 operates board 11 in a second sitting mode in which he sits on board 11 and holds onto board 11. In FIG. 8, rider 27 operates board 11 in a first kneeling mode in which he kneels on board 11 and holds onto handle 25. In FIG. 9, rider 27 operates board 11 in a second kneeling mode in which he kneels on board 11 and holds onto board 11. In FIG. 10, rider 27 operates board 11 in a first standing mode in which he stands on board 11 and holds onto handle 25. In FIG. 11, rider 27 operates board 11 in a second standing mode in which he stands on board 11 and rides hands-free.

Rider 27 may operate water recreation board 11 in any combination of the above-mentioned modes, and is free to change modes during a ride. It is understood that rider 27 may employ other modes of operation not illustrated, such as riding on one knee, or lying on his back. It should be appreciated that the above-mentioned modes of operation that involve holding onto board 11 are particularly useful for riders 27 who are children or who lack sufficient strength to hold onto handle 25 during the initial stage of being towed by the vessel.

In operation, a vessel is provided and rope 23 is attached to the vessel by conventional means. Rope 23 is then passed through eyelet 21 in a direction from lower surface 15 to upper surface 13. Rope 23 is then attached to handle 25 by conventional means. Rider 27 mounts board 11 in a chosen mode of operation, and operates board 11 while being towed by the vessel.

Although the invention has been described with reference to a preferred embodiment, this description is not to be construed in a limiting sense. Various modifications of the disclosed embodiment as well as alternative embodiments of the invention will become apparent to persons skilled in the art upon reference to the description of the invention.

I claim:

1. A rigid water recreation board for towing behind a water vessel comprising:

a board portion;

an eyelet extending through the board portion;

a rope for attachment to the vessel, the rope freely passing through the eyelet; and a handle for attachment to the rope, the handle being dimensioned such that it is larger than the eyelet;

wherein the board is operable in at least the following modes of operation:

(a) a first prone mode, wherein a user lies face down on the board portion, the user further holding onto the handle;

(b) a second prone mode, wherein the user lies face down on the board portion, the user further allowing the handle to be pulled by the vessel until it makes contact with the board portion;

(c) a first kneeling mode, wherein a user kneels on the board portion, the user further holding onto the handle;

(d) a second kneeling mode, wherein the user kneels on the board portion, the user further allowing the handle to be pulled by the vessel until it makes contact with the board portion;

(e) a first sitting mode, wherein a user sits on the board portion, the user further holding onto the handle;

(f) a second sitting mode, wherein the user sits on the board portion, the user further allowing the handle to be pulled by the vessel until it makes contact with the board portion;

(g) a first standing mode, wherein a user stands on the board portion, the user further holding onto the handle; and (h) a second standing mode, wherein the user stands on the board portion, the user further allowing the handle to be pulled by the vessel until it makes contact with the board portion.

2. A method of water recreation comprising the steps of:

providing a water vessel;

providing a rigid board for towing by the vessel, the board having an upper surface and a lower surface;

providing an eyelet extending through the board;

providing a handle, the handle being dimensioned such that it will not pass through the eyelet;

providing a rope adapted for attachment to the vessel;

passing the rope through the eyelet in a direction from the lower surface to the upper surface;

attaching the rope to the handle;

towing the board with the vessel; and operating the board in a mode of operation;

wherein the mode of operation comprises at least:

(a) a first lying mode, wherein a user lies face down on the board, the user further holding onto the handle;

(b) a second lying mode, wherein the user lies face down on the board, the user further allowing the handle to be pulled by the vessel until it makes contact with the board;

(c) a first kneeling mode, wherein a user kneels on the board, the user further holding onto the handle;

(d) a second kneeling mode, wherein the user kneels on the board, the user further allowing the handle to be pulled by the vessel until it makes contact with the board;

(e) a first sitting mode, wherein a user sits on the board, the user further holding onto the handle;

(f) a second sitting mode, wherein the user sits on the board, the user further allowing the handle to be pulled by the vessel until it makes contact with the board;

(g) a first standing mode, wherein a user stands on the board, the user further holding onto the handle; and (h) a second standing mode, wherein the user stands on the board, the user further allowing the handle to be pulled by the vessel until it makes contact with the board.

3. A rigid water recreation board for towing behind a water vessel comprising:

a board portion;

an eyelet carried by the board portion;

a rope for attachment to the vessel, the rope freely passing through the eyelet; and a handle for attachment to the rope, the handle being dimensioned such that it is larger than the eyelet;

wherein the board is operable in at least the following modes of operation:

(a) a first prone mode, wherein a user lies face down on the board portion, the user further holding onto the handle;

(b) a second prone mode, wherein the user lies face down on the board portion, the user further allowing the handle to be pulled by the vessel until it makes contact with the board portion;

(c) a first kneeling mode, wherein a user kneels on the board portion, the user further holding onto the handle;

(d) a second kneeling mode, wherein the user kneels on the board portion, the user further allowing the handle to be pulled by the vessel until it makes contact with the board portion;

(e) a first sitting mode, wherein a user sits on the board portion, the user further holding onto the handle;

(f) a second sitting mode, wherein the user sits on the board portion, the user further allowing the handle to be pulled by the vessel until it makes contact with the board portion;

(g) a first standing mode, wherein a user stands on the board portion, the user further holding onto the handle; and (h) a second standing mode, wherein the user stands on the board portion, the user further allowing the handle to be pulled by the vessel until it makes contact with the board portion.

4. A rigid water recreation board for towing behind a water vessel comprising:

a board portion;

an port extending through the board portion;

a rope for attachment to the vessel, the rope freely passing through the port; and a handle for attachment to the rope, the handle being dimensioned such that it is larger than the port;

wherein the board is operable in a plurality of handle holding modes of operation from the following handle holding modes of operation:

(1) a first prone mode, wherein a user lies face down on the board portion, the user further holding onto the handle;

(2) a first kneeling mode, wherein a user kneels on the board portion, the user further holding onto the handle;

(3) a first sitting mode, wherein a user sits on the board portion, the user further holding onto the handle;

(4) a first standing mode, wherein a user stands on the board portion, the user further holding onto the handle;

wherein the board is operable in a plurality of no-handle modes of operation from the following no-handle modes of operation:

(1) a second prone mode, wherein the user lies face down on the board portion, the user further allowing the handle to be pulled by the vessel until it makes contact with the board portion;

(2) a second kneeling mode, wherein the user kneels on the board portion, the user further allowing the handle to be pulled by the vessel until it makes contact with the board portion;

(3) a second sitting mode, wherein the user sits on the board portion, the user further allowing the handle to be pulled by the vessel until it makes contact with the board portion;

(4) a second standing mode, wherein the user stands on the board portion, the user further allowing the handle to be pulled by the vessel until it makes contact with the board portion.

* * * * *